US006981394B2

(12) United States Patent
Keller

(10) Patent No.: US 6,981,394 B2
(45) Date of Patent: Jan. 3, 2006

(54) TEXTILE FABRIC HAVING RANDOMLY ARRANGED YARN SEGMENTS OF VARIABLE TEXTURE AND CRYSTALLINE ORIENTATION

(75) Inventor: Michael A. Keller, Simpsonville, SC (US)

(73) Assignee: Milliken & Company, Spartanburg, SC (US)

( * ) Notice: Subject to any disclaimer, the term of this patent is extended or adjusted under 35 U.S.C. 154(b) by 47 days.

(21) Appl. No.: 10/835,763

(22) Filed: Apr. 30, 2004

(65) Prior Publication Data

US 2005/0016224 A1 Jan. 27, 2005

Related U.S. Application Data

(63) Continuation-in-part of application No. 10/613,240, filed on Jul. 3, 2003, now Pat. No. 6,832,419, and a continuation-in-part of application No. 10/613,241, filed on Jul. 3, 2003.

(51) Int. Cl.
*D06C 23/00* (2006.01)

(52) U.S. Cl. ..... 66/202; 442/309; 28/163

(58) Field of Classification Search ..... 66/169 R, 66/170, 202, 190–194; 442/304, 308–310; 442/28/140–143, 163, 155, 156, 165, 166; 28/164/21.7–210.8, 210.1
See application file for complete search history.

(56) References Cited

U.S. PATENT DOCUMENTS

| | | | | | |
|---|---|---|---|---|---|
| 4,025,994 | A | * | 5/1977 | Phillips | 28/273 |
| 4,152,886 | A | | 5/1979 | Nelson | 57/208 |
| 4,404,999 | A | | 9/1983 | Woodall, Jr. et al. | 139/391 |
| 4,704,856 | A | | 11/1987 | Nelson | 57/228 |
| 5,132,067 | A | * | 7/1992 | Nelson et al. | 264/210.8 |
| 5,333,364 | A | * | 8/1994 | Enfield et al. | 28/172.2 |
| 5,549,957 | A | | 8/1996 | Negola et al. | 428/92 |
| 6,129,879 | A | | 10/2000 | Bersted et al. | 264/211.14 |

* cited by examiner

*Primary Examiner*—Danny Worrell
(74) *Attorney, Agent, or Firm*—Terry Moyer; Jeffery E. Bacon

(57) ABSTRACT

A knit fabric wherein at least a portion of the interconnected yarn loops are formed from segments of a common yarn of multi-filament construction. In the fabric the common yarn includes a first group of yarn segments having a first average cross-sectional filament area and at least a second group of yarn segments having a second average cross-sectional filament area. The second average cross-sectional filament area is greater than the first average cross-sectional filament area. The average level of crystalline orientation of the first group of yarn segments is greater than the average level of crystalline orientation of the second group of yarn segments.

24 Claims, 8 Drawing Sheets

*FIG. —1—*

PRIOR ART

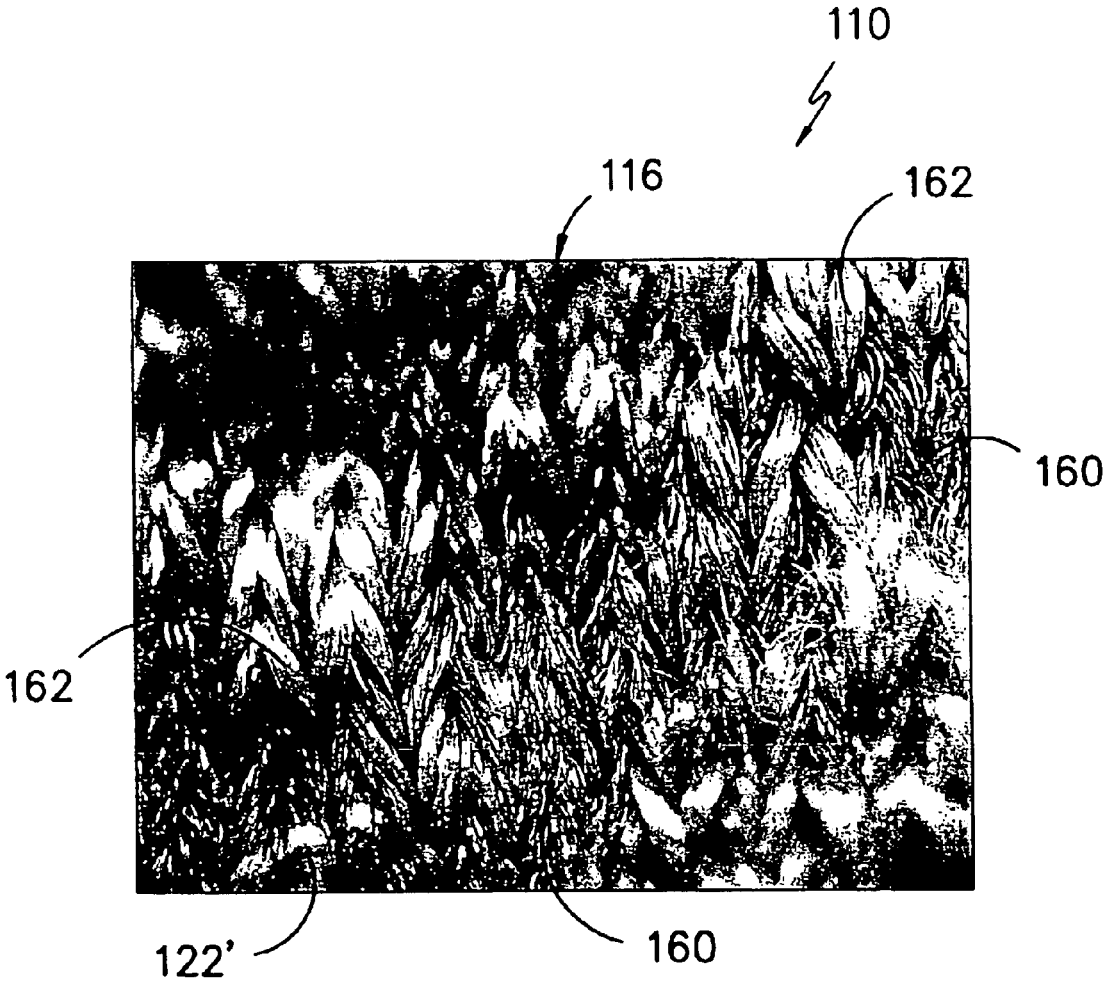
*FIG. —9—*

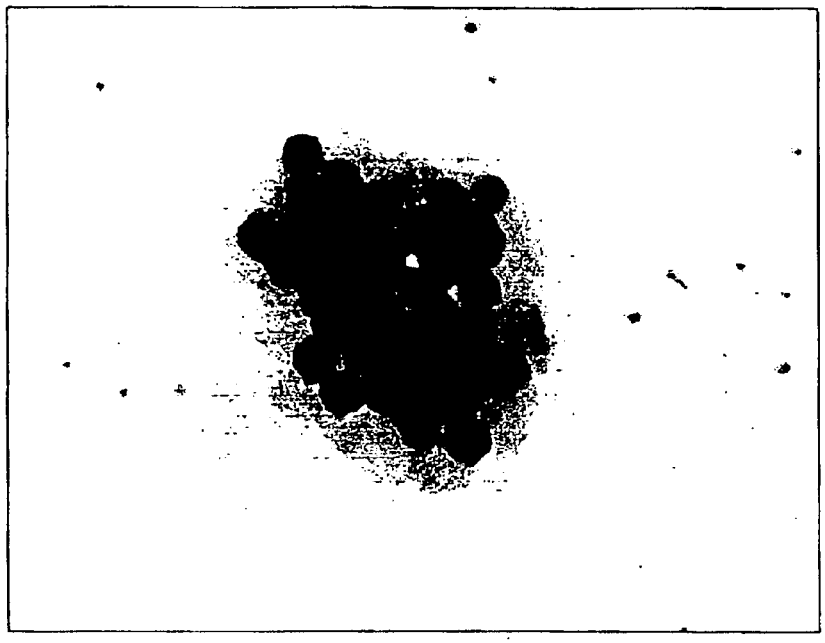
FIG. –10–
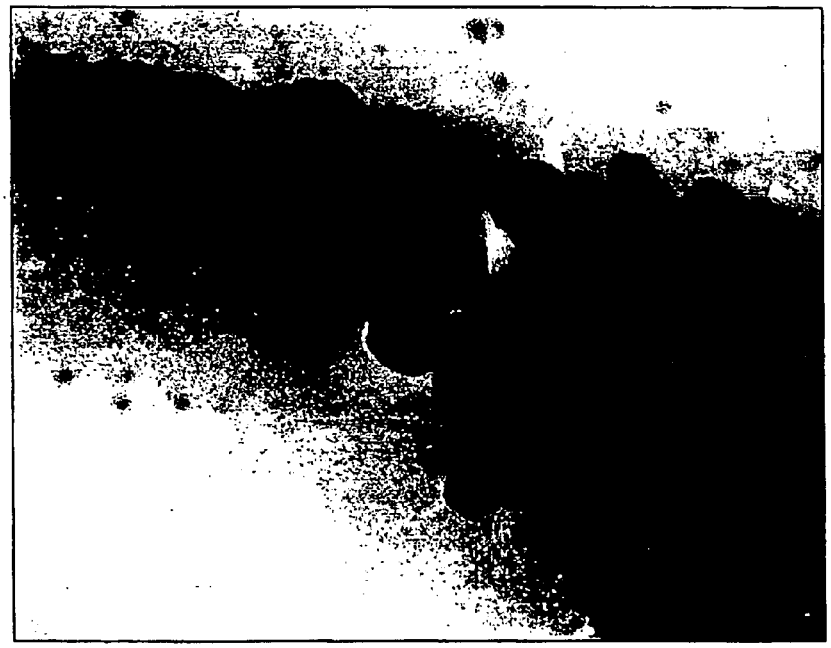
FIG –10A–

TEXTILE FABRIC HAVING RANDOMLY ARRANGED YARN SEGMENTS OF VARIABLE TEXTURE AND CRYSTALLINE ORIENTATION

CROSS-REFERENCE TO RELATED APPLICATIONS

This application is a continuation-in-part of prior U.S. application Ser. No. 10/613,240, filed Jul. 3, 2003 now U.S. Pat. No. 6,832,419 entitled Pile Fabric and Heat Modified Fiber and Related Manufacturing Process and a continuation-in-part of prior copending U.S. application Ser. No. 10/613,241 filed Jul. 3, 2003 entitled Method of Making Pile Fabric the contents of all of which are incorporated by reference herein in their entirety.

TECHNICAL FIELD

The present invention relates generally to textile fabrics having a surface formed from an arrangement of multi-filament yarns of variable character and more particularly to knit fabrics in which zones along surface forming yarns undergo enhanced selective shrinkage resulting in self texturing and reduced crystalline orientation relative to other portions of the same yarn such that the fabric surface has substantially random zones of variable texture. A method of imparting the variable performance characteristics to the yarns and of forming the fabric is also provided.

BACKGROUND OF THE INVENTION

So-called flat knit fabrics such as warp knit and weft knit fabics are well known. Such fabrics are formed by the interlocking of loops of yarn so as to form a coordinated structure. In single needle bar knitting single and multiple yarn systems may be utilized. By way of example only, such fabrics may be formed by techniques such Raschel and tricot knitting as will be well known to those of skill in the art. Such fabrics may also be formed by other techniques such as tufting and stitch bonding as will also be well known to those of skill in the art. Of course, other formation techniques may also be utilized as well.

If desired, a degree of variability may be introduced across the fabric face by the introduction of defined patterns of the interlocking loops. However, such patterns which are introduced as the result of adjustment of machine settings provide a substantially regular pattern of loops and voids across the surface of the fabric. These regular patterns may be discernible upon visual inspection of the fabric thus failing to provide the appearance of random occurrence.

In the past, knit fabrics have been formed from fully drawn multi-filament yarns wherein the yarns are drawn and heatset under tension so as to extend and orient the individual filaments. In such a process each of filaments in the yarn is subjected to a substantially uniform heating and extension treatment such that the yarn will thereafter act in a uniform manner upon post fabric formation treatments such as heat setting, hot dyeing and the like. That is, since the yarn has been uniformly treated it does not exhibit variable response characteristics when subjected to heating or other treatment conditions.

It is also known to form knit fabrics having a cut pile from yarns which are subjected to a substantially uniform heat treatment during drawing but which are not fully drawn. Such a process is illustrated and described in U.S. Pat. No. 5,983,470 to Goineau the contents of which are incorporated herein by reference in their entirety. The resultant fabric has a generally striated appearance upon dyeing.

SUMMARY OF THE INVENTION

According to one aspect, the present invention provides advantages and alternatives over the known art by providing a knit fabric formed from a multiplicity of cooperatively engaging yarn loops such that a portion of the yarn loops define a fabric surface. The yarn forming the fabric face has variable shrinkage characteristics at different segments (also referred to as zones) along its length such that when such yarn is introduced into the fabric and is thereafter subjected to heat such as through heated finishing and/or dyeing at elevated temperature, discrete portions of the yarn shrink preferentially thereby tightening up sections of the loop underlaps. This tightening causes the portions of the yarn which do not shrink to become raised in the fabric face. The shrinking of segments along the surface-forming yarn yields substantially random arrangements of unshrunken yarn segments of substantially parallel fibers in combination with shrunken yarn segments of self textured filaments with reduced crystalline orientation in the same yarn. The resultant fabric has an irregular surface appearance and texture.

BRIEF DESCRIPTION OF THE DRAWINGS

The present invention will now be described by way of example only, with reference to the accompanying drawings which constitute a portion of the specification herein and wherein:

FIG. 9 illustrates a knit fabric of construction similar to FIG. 1, incorporating the surface forming yarn with variable shrinkage zones following hot drawing and post formation heat treatment wherein zones of the surface forming yarn have undergone selective shrinkage and self texturing;

FIG. 10 is a photomicrograph of fiber cross-sections in low shrink portions of a formation yarn according to the present invention; and FIG. 10A is a photomicrograph of fiber cross-sections in high shrink self-textured portions of a formation yarn according to the present invention at the same magnification as FIG. 10.

While the present invention has been generally described above and will hereinafter be described in greater detail in relation to certain illustrated and potentially preferred embodiments, procedures and practices it is to be understood that in no event is the invention to be limited to such illustrated and described embodiments, procedures and practices. Rather, it is intended that the invention shall extend to all embodiments, practices and procedures as may be embodied within the broad principles of the invention.

DESCRIPTION OF THE PREFERRED EMBODIMENTS

Figure 1:
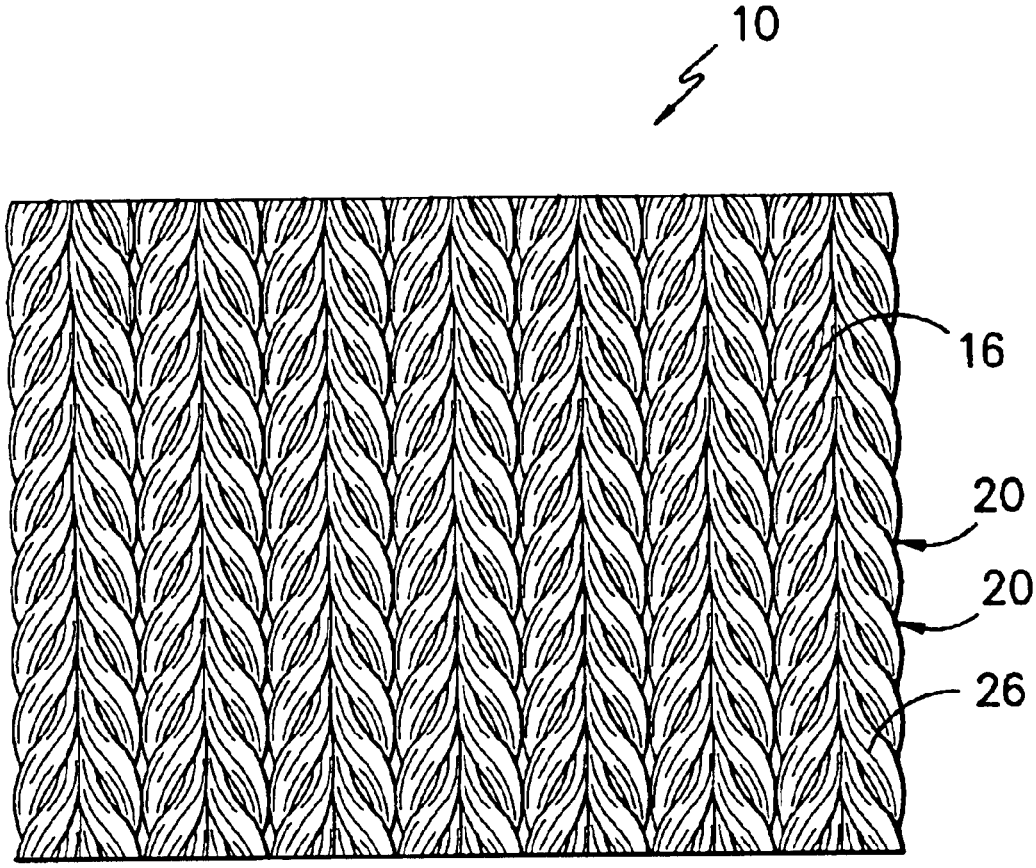
FIG. 1 illustrates a surface view of a representative prior art flat knit fabric of uniform surface character.

Reference will now be made to the various figures wherein, to the extent possible, like elements are designated by like reference numerals throughout the various views. In FIG. 1 there is illustrated a typical prior art flat knit fabric 10 such as may be formed in a warp knit construction with elongated underlaps as will be well known to those of skill in the art. As shown, the fabric 10 face portion portion 16 made up of a multiplicity of interconnected loops 20 formed from yarns. As illustrated, the face-forming yarns are made up of multiple discrete filaments 26.

The yarns in such prior art knit fabrics have typically undergone a hot drawing operation so as to impart a uniform heat treatment and extension to the filaments 26 prior to formation into the fabric 10. By way of example only, according to one typical process the yarns are fully drawn to approximately 1.7 times their initial length while being subjected to a temperature of about 200° C. prior to formation into a fabric construction. This drawing and heat treatment imparts enhanced crystallite orientation to the yarn while also providing a substantially uniform heat history such that the propensity to undergo further shrinkage is minimized and any shrinkage which does occur after the yarn is formed into a fabric will be substantially uniform. Thus, the yarns forming the face portion 16 are of substantially uniform character upon initial formation and react in substantially the same manner when subjected to post-formation heat treatment such that uniform texture characteristics and filament alignment are maintained after the fabric is heat set and dyed.

Figure 2:
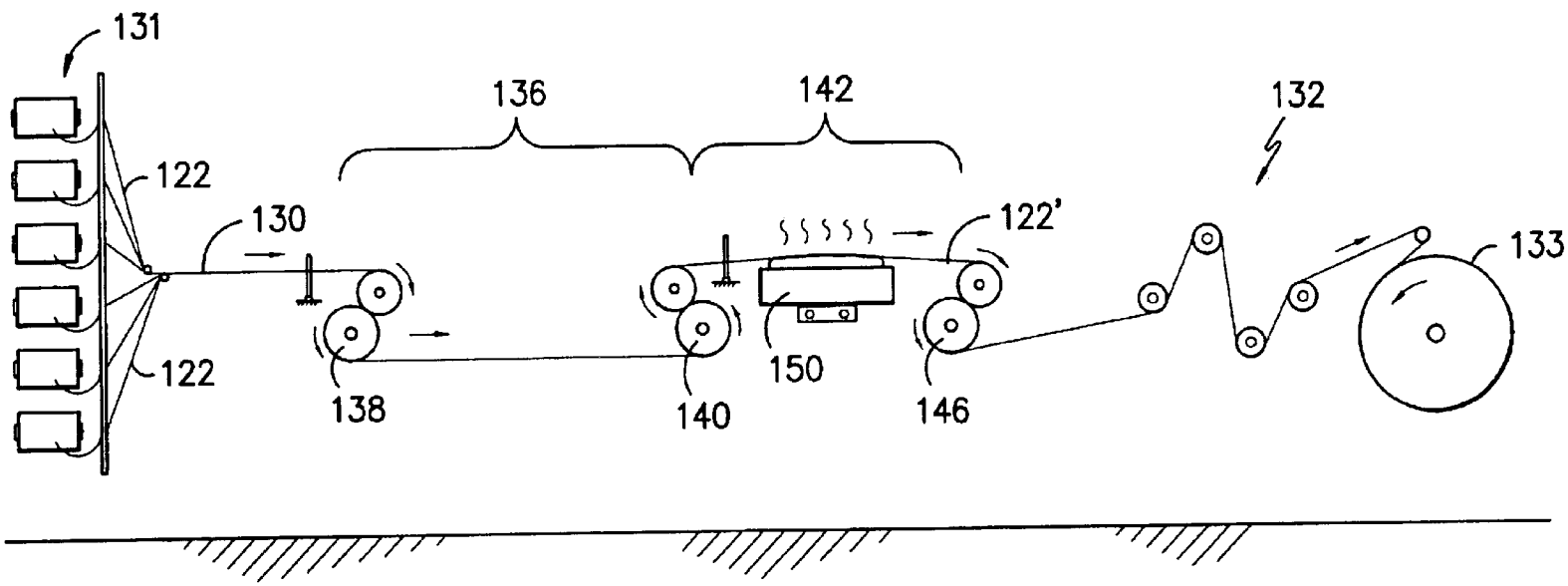
FIG. 2 illustrates schematically a practice for hot drawing a surface-forming yarn to impart variable shrink characteristics at zones along the length of such yarn.

Referring to FIG. 2, according to a potentially preferred practice of the present invention a yarn sheet 130 formed from a plurality of yarns 122 is passed from a creel 131 through a drawing apparatus 132 to a take-up 133. The yarns 122 are so called "partially oriented yarns" of multi-filament construction wherein the filaments 126 (FIG. 4) have been interlaced at discrete zones along the length of the yarn. In practice it is contemplated that the yarns are formed from a heat shrinkable material, such as a thermoplastic. By way of example only and not limitation, exemplary fiber materials may include polyester, polypropylene, nylon and combinations thereof. As will be appreciated, when such materials are extruded from a melt solution into elongated filaments, those filaments have an intrinsic finite shrinkage potential which is activated upon subsequent heat exposure. During heat exposure shrinkage will proceed until the shrinkage potential is exhausted or the heating is terminated.

As shown, the drawing apparatus 132 has a first draw zone 136 located between tensioning rolls 138, 140 and a second draw zone 142 located between tensioning rolls 140 and 146. A contact heating plate 150 as will be well known to those of skill in the art engages the yarns 122 within the second draw zone 142. According to the potentially preferred practice, the partially oriented yarns 122 are passed through the first draw zone 136 with substantially no heating or drawing treatment. Thus, the yarns 122 are substantially unaltered upon entering the second draw zone 142. At the second draw zone the yarns 122 preferably undergo a relatively slight drawing elongation while simultaneously being subjected to a relatively low temperature heating procedure from the contact heater 150. Since the resultant yarn 122' is not drawn to a condition of full orientation it is referred to as "underdrawn" yarn.

According to the potentially preferred practice the yarn is conveyed across the contact heater 150 at a high rate of speed such that the yarn does not reach a state of temperature equilibrium within the cross-section of the yarn at all segments. By way of example only, and not limitation, for a 115 denier polyester yarn it has been found that subjecting such yarn to a draw ratio of about 1.15 (i.e. 15% elongation) with a contact heater temperature of about 170 C to about 200 C with a take up speed of about 500–600 yards per minute provides the desired non-uniform cross-sectional heat treatment at some segments of the yarn while yielding a uniform cross-sectional heat treatment at other segments. Of course, the level of drawing, temperature and speed may be adjusted for different yarns.

The resultant yarn 122' may then be formed into a fabric and heat treated to provide desired surface characteristics in the manner as will be described further hereinafter. Of course, it is also contemplated that the yarn 122' may be subjected to heat treatment prior to introduction into a fabric if desired. In either case, discrete segments of the yarn 122' undergo shrinkage and self-texturing while other segments along the same yarn experience little if any change.

Figure 4:
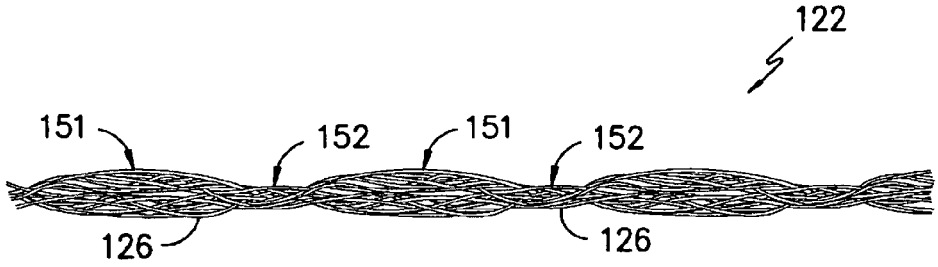
FIG. 4 illustrates a partially oriented non-textured multi-filament yarn prior to hot drawing.

The mechanism believed to be responsible for the non-uniform character of the yarns is believed to relate to the nature of the partially oriented yarn 122 being processed as well as the process conditions. Referring to FIG. 4, a representative illustration is provided of a partially oriented yarn (POY) 122 such as may be treated according to the practice described above. As illustrated, the yarn 122 of partially oriented construction is characterized by loose zones 151 in which the individual filaments 126 are disposed in generally aligned loose orientation relative to one another. These loose zones 151 are interspersed by discrete interlace nodes 152 in which the filaments are interlaced in a more compacted relation so as to hold the overall yarn 122 together. The cross-sectional heat transfer characteristics of the loose zones 151 are believed to be substantially different from that of the interlace nodes 152 and the yarn portions immediately adjacent such nodes.

Figure 5:
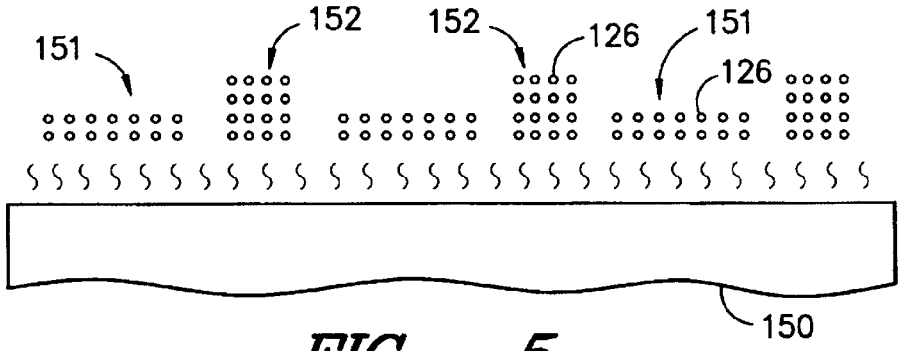
FIG. 5 is a graphical representation illustrating the cross-sectional profile of yarn filaments at different zones along the length of the yarn of FIG. 4 during hot drawing.

In FIG. 5 a graphical illustration of the fiber cross-section is provided showing the relative response of the filaments 126 in the loose zones 151 and interlace nodes 152 of the yarn during heating under slight draw conditions as described above. In particular, what is seen is that the filaments within the loose zones 151 are pulled towards the heater by a combination of tensioning and heat shrinkage so as to assume a relatively low cross-sectional profile orientation across the contact heater 150. This low cross-sectional profile allows those zones to receive a substantially uniform and complete heat treatment despite the high speed of travel across the heater. Conversely, the relatively slight degree of draw applied is inadequate to pull out the interlace nodes 152. Thus, flattening and spreading of the filaments at the interlace nodes is avoided. Thus, upon high speed underdrawing conditions the yarn portions around the interlace nodes 152 retain a higher more concentrated profile across the heater 150 rather than flattening out like the loose zones 151.

It is surmised that due to the lack of flattening and the high rate of travel across the heater, heat treatment is not uniform within the interlace nodes and adjacent portions. Thus, the filaments at those areas retain a relatively high level of shrinkage potential since a steady state temperature is not reached. The retention of such shrinkage potential leaves such zones susceptible to subsequent enhanced heat shrinkage relative to the remaining portions of the yarn (which have been subjected to uniform temperature treatment) upon subsequent heat application.

Variable Shrinkage and Bulking Evaluation:

The enhanced retained shrinkage potential of the yarn at the interlace nodes relative to the intermediate loose zones following the treatment process as outlined above has been confirmed by cutting out segments of an exemplary 260 denier polyester yarn treated according to the procedure outlined above and thereafter subjecting those cut out segments to a uniform heat treatment and then measuring the level of shrinkage caused by the heat treatment. In particular, a first group of two yarn segments was cut out from sections between interlace nodes such that each of the two cut out yarn segments in this first group was substantially devoid of any interlace node. A second group of three yarn segments was cut out from the yarn such that each of the three cut out yarn segments in this second group was formed substantially of a single interlace node. Both the first group and the second group of yarn segments were then subjected to a high temperature superheated steam treatment to observe shrinkage. The results are set forth in Table I below showing that the second group of yarn segments formed from the interlace nodes exhibited substantially increased shrinkage on a percentage basis relative to the yarn segments in the first group devoid of interlace nodes.

TABLE I

| Sample Segment | Percent Shrinkage After Heat Treating |
|---|---|
| Sample 1 - Interlace Node Segment | 43% |
| Sample 2 - Interlace Node Segment | 40% |
| Sample 3 - Interlace Node Segment | 33% |
| Sample 4 - No Interlace Nodes | 10% |
| Sample 5 - No Interlace Nodes | 0% |

In addition to shrinkage, it was also observed that the yarn segments formed from the interlace nodes underwent an enhanced degree of bulking and self texturing resulting in substantial filament thickening as shown in FIG. 10A.

Figure 6:
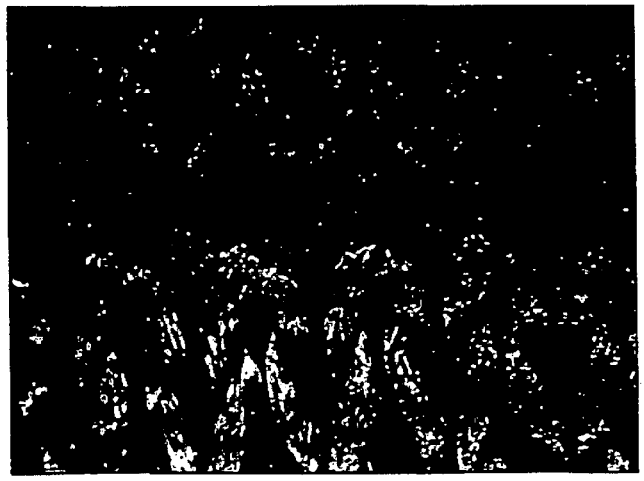
FIG. 6 is a photomicrograph of a circular knit sock illustrating variable shrinkage segments of a formation yarn.

Crystalline Orientation Evaluation:

It has also been found that after heat treatment (such as occurs in fabric finishing) segments of the same yarn treated according to the procedures as previously described are characterized by substantially different levels of crystalline orientation as measured by wide angle x-ray diffraction. In order to characterize the molecular structure of the two different types of domains in a finished construction, a polyester yarn treated according to the process as illustrated and described in relation to FIG. 2 was circularly knitted into a sock (i.e. a tube), dyed, and finished. The finished sock exhibited two distinct types of courses: open courses consisting of yarn that had low shrinkage during finishing, and tight courses consisting of yarn that had high shrinkage during finishing. FIG. 6 illustrates a zone in the sock containing these two regions. Importantly, it is to be understood that the same yarn is used throughout the sock and that the different zones emerged only after subsequent heat treatment.

To understand the differences in the zones of the sock individual courses of each type of region were removed from the construction for x-ray measurement. Courses were 'double-folded' to form a 4-ply yarn so as to increase the scattering signal rate and reduce the necessary exposure time. Samples were mounted onto standard x-ray sample mounts.

Wide-angle diffraction patterns were generated via exposure to x-rays generated with a rotating copper anode source having a primary wavelength of 1.5418 Å. Patterns were recorded using a general area detector system offset to an angle of $2\theta=16.5°$ and set 15 cm from the sample position. Samples were oriented in the beam such that the fiber axis was vertical. Exposures of 15 minutes were used to generate patterns, and a background pattern acquired over an empty position on the sample holder was subtracted from the resulting data.

Figure 7A:
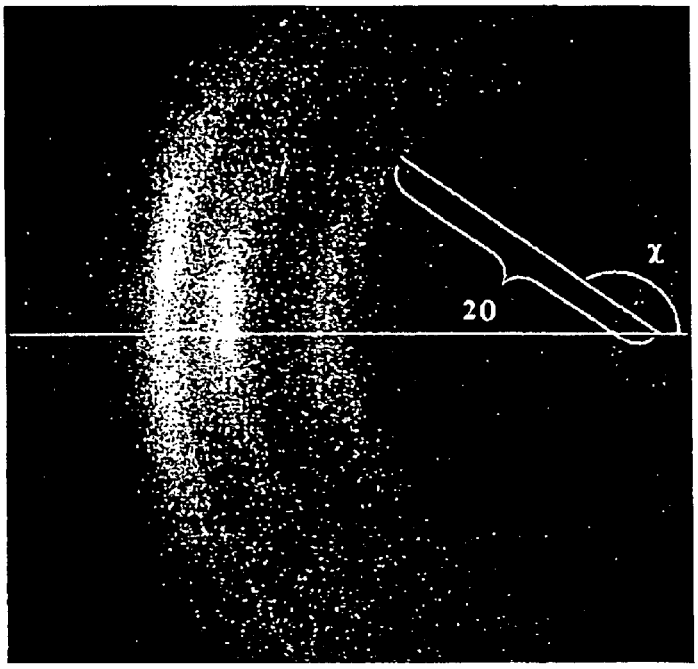
FIGS. 7A and 7B are x-ray diffraction patterns for high shrink and low shrink portions of a formation yarn respectively.
Figure 7B:
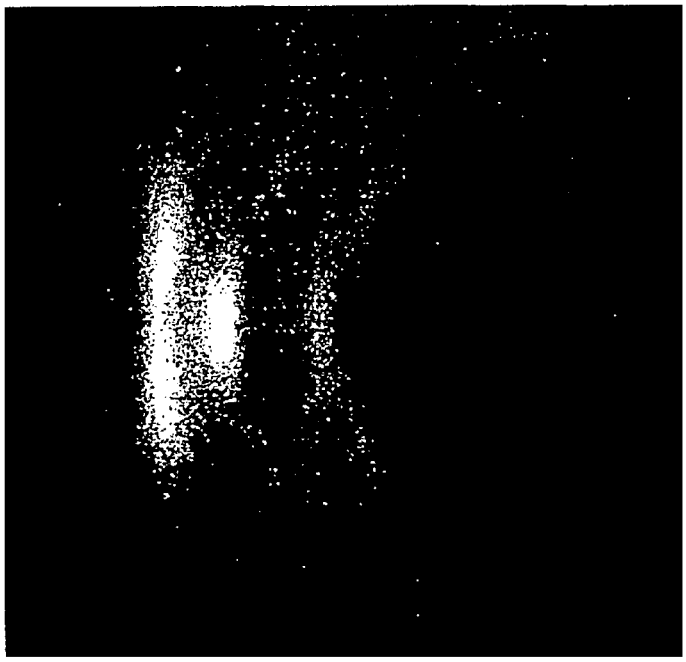

The diffraction pattern for the high-shrink yarn sample is shown in FIG. 7A and that for the low-shrink yarn is shown in FIG. 7B wherein the lighter zones identify higher reflection intensity levels. Qualitatively, it was observed that in the two patterns the crystal plane reflections (the broad intensity peaks) in the high-shrink sample have a greater azimuthal spread than those in the low-shrink sample. It is known that the two primary causes of azimuthal spreading in multifilament fiber samples are misalignment of individual filaments and differences in the angular distribution of crystallites between the samples. Great care was taken during sample preparation to properly parallelize the filaments, and a slight tension was applied to maintain good orientation during handling and measurement. Thus, it is very unlikely that filament disorientation alone can account for the differences in angular peak distribution observed in the patterns. Therefore, it was determined that the azimuthal spread reflects a real difference in the angular distribution of crystallites between the two samples.

It is known that the difference in the angular distribution of crystallites between the two samples can be quantified in terms of the Herman orientation function:

$$f_c = \frac{3\langle\cos^2\sigma\rangle - 1}{2}$$

where $\sigma$ is the relative angle of the PET chain axis. As will be appreciated, the Herman orientation function is a measure of the orientation of PET chains within fiber crystallites with respect to the fiber axis direction. It assumes values ranging from +1 (perfectly oriented parallel to the axis) to 0 (perfectly random) to −½ (perfectly oriented perpendicularly). For cylindrically symmetric (on average) fibers, the distributional average of the square cosine term is given by:

$$\langle\cos^2\chi\rangle = \frac{\int_0^{\pi}\cos^2\chi I_p(\chi)\sin\chi\, d\chi}{\int_0^{\pi} I_p(\chi)\sin\chi\, d\chi}.$$

Where $I_P(\chi)$ is the angular distribution of a directional vector P (in this case, the PET chain direction) as measured with respect to a reference direction, in this case the fiber axis.

In PET there does not exist a crystalline reflection in the direction of the PET chains. Thus, to determine the Herman orientation function for PET chains a well recognized geometric relationship is utilized to develop the square cosine term.

$$\langle\cos^2\sigma\rangle = 1 - 0.8786\langle\cos^2\chi_{(010)}\rangle - 0.7733\langle\cos^2\chi_{(110)}\rangle - 0.3481\langle\cos^2\chi_{(100)}\rangle,$$

where $\sigma$ is the relative angle of the PET chain axis, and $\chi_{(hk0)}$ are the relatives angles of the (hk0) crystalline reflections. This relationship was described by Z. Wilchinsky in *Journal of Applied Physics* 30, 792 (1959) the contents of which are incorporated herein by reference.

Figure 8A:
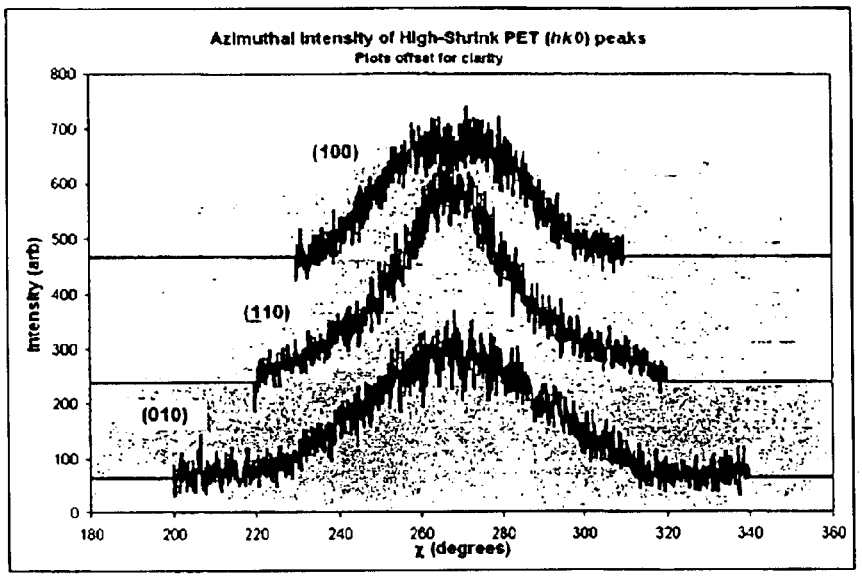
FIGS. 8A and 8B are angular distribution plots of select diffraction peaks for high shrink and low shrink portions of a formation yarn respectively.
Figure 8B:
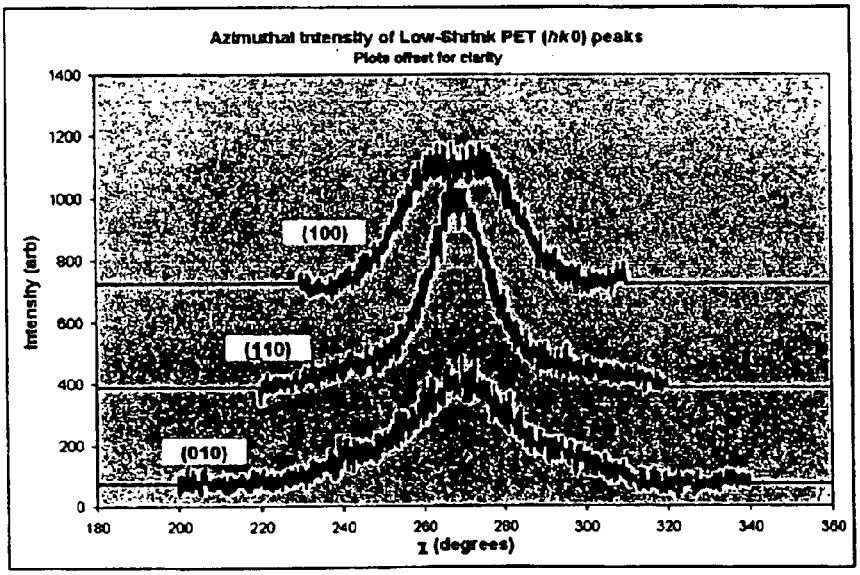

The $<\cos^2\chi_{(hk0)}>$ terms can be numerically computed by extracting the $I_{(hk0)}(\chi)$ distributions from the measured diffraction patterns. Angular distributions were computed by integrating the pattern signals over a 0.7° range of 2θ values centered on the following positions: 17.65° for the (010) reflection, 22.75° for the (110) reflection, and 25.35° for the (100) reflection. Distributions of x-ray peaks for the high shrink and low shrink yarn segments (used for purposes of integration) are shown in FIGS. 8A and 8B. Because of the limited detector area, distributions were extrapolated out to the full 180° range by assuming the signal at high angles was due solely to amorphous scattering. This amorphous baseline was subtracted from the distributions before numerical integration.

Results from the numerical determination of the Herman orientation function (*fc*) are shown in Table II below. As shown, the low-shrink yarn sample possessed a measurably higher level of orientation.

TABLE II

| | High Shrink | Low Shrink |
|---|---|---|
| <cos^2(θ100)> | 0.060 | 0.038 |
| <cos^2(θ110)> | 0.087 | 0.062 |
| <cos^2(θ010)> | 0.108 | 0.083 |
| <cos^2(σ)> | 0.817 | 0.866 |
| Herman fc | 0.725 | 0.799 |

In order to confirm the legitimacy of the crystalline orientation evaluations on the treated yarn of the present invention, a control analysis was conducted on a standard fully drawn 265 denier 36 filament partially oriented PET yarn that had been cold drawn with a 2.1 draw ratio and heat set at 220 C. Three samples were taken from segments 6 to 12 inches apart along the length of the yarn and x-ray patterns were generated using 45 minute exposures. An air scattering frame was also acquired and subtracted from the data before analysis. The same calculations were performed as described above. The Herman orientation function calculated based on the measurements of these samples ranged from 0.819 to 0.853 which is a difference of 0.034. This is less than half the difference of 0.074 measured for the high shrink and low shrink portions of the yarn. Thus, there exists a much greater variation in crystalline orientation between portions of the yarns of the present invention following heat treatment than in standard yarns.

Based on the evaluations carried out it may be seen that the interlaced nodes along the yarn give rise to the high shrink portions of the yarn. Moreover, upon application of heat treatment these high shrink portions shrink to a greater degree and have a lower level of crystalline orientation (as measured by the Herman Orientation Function) than the low shrink portions. Moreover, the degree of variation in crystalline orientation along the length of the yarns of the present invention is substantially greater than variations in standard yarns.

Figure 3:
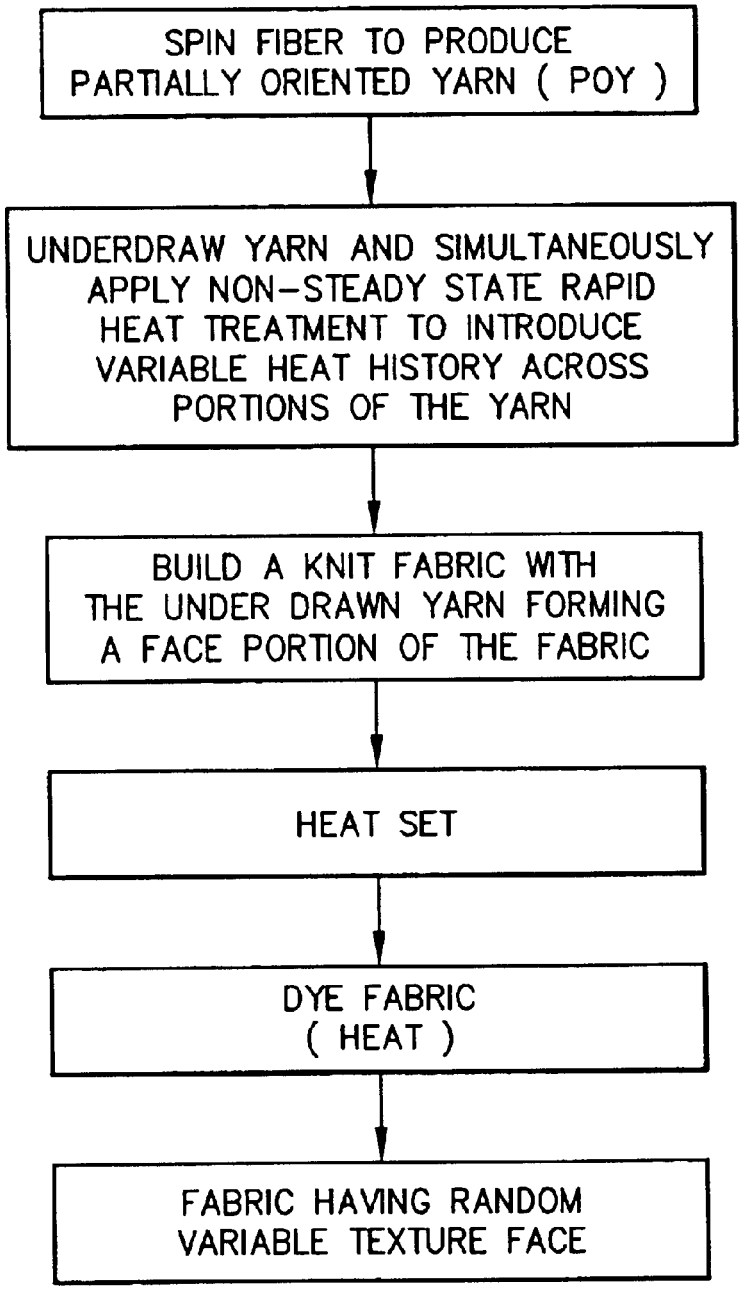
FIG. 3 is a block diagram setting forth steps for forming a variable surface texture knit fabric.

Fabric Formation:

As will be appreciated through reference to FIG. 3, subsequent to the introduction of variable heat treatment across portions of the yarn to introduce the above-described variable shrinkage characteristics, the yarn 122' may thereafter be formed into a knit fabric such as is illustrated and described in reference to FIG. 1. That is, the formed greige fabric is characterized by face-forming loops which are substantially uniform in texture. However, due to the variable heat treatment history at segments along the face-forming yarns, when the formed greige fabric is heat set and/or dyed at prolonged elevated temperatures, segments of the face-forming yarn react in dramatically different fashions thereby imparting a variability to the finished fabric. In particular, portions of the pile-forming yarns which made up the interlace nodes 152 and adjacent areas and which did not undergo a uniform heat treatment during drawing tend to undergo selective shrinkage during the heat setting and/or dyeing operations. As explained above, this shrinkage occurs as a result of the fact that the shrinkage potential within these yarn zones has not been relieved previously. Conversely, the yarn portions which were in the loose portions of the yarn between the interlace nodes do not undergo substantial shrinking during the heat setting and/or dyeing operation since shrinkage potential has been relieved previously.

A resultant fabric structure following heating is illustrated in FIG. 9. As will be appreciated, the heating may be carried out as a heat treatment during finishing, as an elevated dyeing treatment or any such other suitable elevated temperature operation as may be desired. As shown, although the same yarns 122' are utilized throughout the face portion 116 of the fabric 110, discrete segments of those yarns have undergone shrinkage so as to form self textured entangled segments 160 across the fabric. The segments of the yarns which have undergone uniform heat treatment during the initial warp drawing operation do not undergo such shrinkage and thus define arrangements of substantially unaltered surface loops 162 wherein the filaments remain substantially aligned with relatively low levels of crimping and entanglement.

As in the individual yarn samples evaluated, due to the shrinkage of the filaments 126 at different yarn segments in the fabric, the filaments within the self textured segments 160 of the face are characterized by a substantially greater diameter than the filaments in the unaltered surface loops. By way of example only, for purposes of comparison photomicrographs are provided of filament cross sections in exemplary low shrink yarn portions (FIG. 10) as well as in self textured yarn segments (FIG. 10A). In this regard it is contemplated that in order to realize the aesthetic and tactile benefits of the variable shrinkage zones along the surface-forming yarns, the filaments making up the self-textured segments will preferably have an average diameter at least about 25 percent greater (more preferably at least about 50 percent greater) than the average diameter of the filaments forming the low shrink portions. For yarns formed from filaments with non-circular cross-sections the difference between the high shrink and low shrink portions may be measured in terms of cross-sectional area. For yarns formed from either circular or non-circular filaments, the high shrink segments will preferably have an average cross-sectional area at least about 1.56 times (more preferably at least about 2.25 times) the average area of the filaments forming the low shrink segments. In the illustrated exemplary constructions, a comparison of the filaments of FIGS. 10 and 10A shows that some of the filaments in the self textured high shrink segments are at least twice the diameter of some of the filaments in the low shrink portions. Thus, for yarns formed from non-circular filaments it is contemplated that at least a portion of the filaments in the high shrink segments will have a cross-sectional area 4 times the area of some filaments forming the low shrink segments.

By way of example only, within a yarn 122' according to the present invention it is contemplated that the number of interlace nodes will preferably be in the range of about 10 to 40 nodes per meter with each node taking up about 0.6 to about 1.3 cm. Thus, it is contemplated that zones of high retained shrinkage potential will preferably make up about 6% to about 52% percent of the total length of the yarn and will more preferably make up about 25% of the total length of the yarn.

As previously indicated, a substantial benefit of the present invention is that the self-textured segments of heat shrunk yarn are present across the surface of the fabric in a substantially random arrangement. This imparts a substantially natural random look which may be desirable in many instances. Moreover, since the self-textured zones undergo heat shrinkage as a result of activating intrinsic heat shrink potential, such shrinkage occurs without embrittlement thereby enhancing a soft feel and avoiding filament breakage leading to undesirable shredding. In this regard it is to be understood that the terms "self texturing" or "self-crimping" refers to the characteristic that the filaments have a crimped construction after shinkage without the application of external crimping or texturizing procedures. As previously indicated, after self-texturing takes place, the high shrink portions of the yarn have a lower level of crystalline orientation than the low shrink portions. In this regard it is contemplated that the level of crystalline orientation of the low shrink portions of the yarn as measured by the Herman Orientation Function will on average be at least 5% greater (and more preferably at least 10% greater) than the level of crystalline orientation of the high shrink portions.

The invention may be further understood through reference to the following non-limiting examples.

EXAMPLE I

A 115 denier 36 filament semi-dull round partially oriented polyester yarn was subjected to a 1.143 draw across a contact Dowtherm heater plate operated at a temperature of 200 C. The heater contact length was 17 inches and the yarn was taken up off of the heater at a rate of 600 yards per minute. The yarns were spaced at a density of approximately 17.4 yarns per inch across the heater. The warper tension was set at 25 to 30 grams. Overall draw ratio was 1.165. Measurements of the post drawn yarn indicated a linear density of 100.5 denier and a boiling water shrinkage of 14.7%. The drawn yarn was knitted into the face of a 2 bar Tricot knit fabric with the ground being formed of a 70 denier 36 filament semi-dull round fully warpdrawn polyester. The bar 1 (face yarn) runner length was 102 inches. The bar 2 (ground yarn) runner length was 46 inches. The knitting machine was fully threaded. The resultant fabric had 60 coarses per inch. The fabric was jet dyed according to a standard disperse dye cycle at 280° F., held for 20 minutes with a 2° F. per minute temperature ramp up. The fabric was wet pad tenter dried at a temperature of 300° F. passing through the tenter at 20 yards per minute. The exit width after drying was 59.5 inches. The resultant fabric had random high loops with relatively greater oriented crystalline regions than the low loops which were characterized by very low order orientation of the crystals as measured by wide angle X-ray scattering.

EXAMPLE 2

A 115 denier 36 filament semi-dull round partially oriented polyester yarn was subjected to a 1.143 draw across a contact Dowtherm heater plate operated at a temperature of 175 C. The heater contact length was 17 inches and the yarn was taken up off of the heater at a rate of 600 yards per minute. The yarns were spaced at a density of approximately 17.4 yarns per inch across the heater. The warper tension was set at 25 to 32 grams. Overall draw ratio was 1.165. Measurements of the post drawn yarn indicated a linear density of 100.0 denier and a boiling water shrinkage of 12.04%. The drawn yarn was knitted into the face of a 4 bar 56 gauge Raschel knit fabric. The bar 1 yarn (tie down stitch) bar 2 yarn (tie down stitch) and bar 4 (ground yarn) were all formed of 70 denier 36 filament semi-dull round fully warpdrawn polyester. The face yarn was threaded in Bar 3. The bar 1 runner length was 60 inches. The bar 2 runner length was 60 inches. The bar 3 (face yarn) runner length was 102 inches. The bar 4 ground yarn runner length was 60 inches. The resultant fabric had 49.5 coarses per inch. The fabric was jet dyed at 280° F., held for 20 minutes with a 2° F. per minute temperature ramp up. The fabrics were wet pad tenter dried at a temperature of 300° F. passing through the tenter at 20 yards per minute. The exit width after drying was 53 inches. The resultant fabric had random high loops with relatively greater oriented crystalline regions than the low loops which were characterized by very low order orientation of the crystals as measured by wide angle X-ray scattering. The tiedown stitching pronounced the height of the tall loops.

What is claimed is:

1. A knit fabric comprising a face portion including a plurality of interconnected yarn loops, wherein at least a portion of the interconnected yarn loops are formed from segments of a common yarn of multi-filament construction and wherein in the fabric the common yarn comprises a first group of yarn segments having a first average cross-sectional filament area and at least a second group of yarn segments having a second average cross-sectional filament area which is greater than the first average cross-sectional filament area, and wherein in the fabric the average level of crystalline orientation of the first group of yarn segments as measured by the Herman Orientation Function is at least 5% greater than the average level of crystalline orientation of the second group of yarn segments.

2. The invention as recited in claim 1, wherein the average level of crystalline orientation of the first group of yarn segments as measured by the Herman Orientation Function is at least 6% greater than the average level of crystalline orientation of the second group of yarn segments.

3. The invention as recited in claim 1, wherein the average level of crystalline orientation of the first group of yarn segments as measured by the Herman Orientation Function is at least 7% greater than the average level of crystalline orientation of the second group of yarn segments.

4. The invention as recited in claim 1, wherein the average level of crystalline orientation of the first group of yarn segments as measured by the Herman Orientation Function is at least 8% greater than the average level of crystalline orientation of the second group of yarn segments.

5. The invention as recited in claim 1, wherein the average level of crystalline orientation of the first group of yarn segments as measured by the Herman Orientation Function is at least 9% greater than the average level of crystalline orientation of the second group of yarn segments.

6. The invention as recited in claim 1, wherein the fabric is a Tricot knit fabric.

7. The invention as recited in claim 1, wherein the fabric is a Raschel knit fabric.

8. The invention as recited in claim 1, wherein the common yarn is a multi-filament PET polyester yarn.

9. The invention as recited in claim 1, wherein in the fabric the first group of yarn segments of the common yarn comprises a plurality of substantially smooth parallel yarn filaments and the second group of yarn segments of the common yarn is characterized by a substantially non-parallel arrangement of crimped yarn filaments.

10. The invention as recited in claim 1, wherein in the fabric the second average cross-sectional filament area is at least 1.56 times the first average cross-sectional filament diameter.

11. The invention as recited in claim 10, wherein in the fabric at least a portion of the yarn filaments in the second group of yarn segments are characterized by a cross-sectional area which is at least 4 times the cross-sectional area of one or more yarn filaments in the first group of yarn segments.

12. A knit fabric comprising a face portion including a plurality of interconnected yarn loops, wherein at least a portion of the interconnected yarn loops are formed from segments of a common yarn of multi-filament construction and wherein in the fabric the common yarn comprises a first group of yarn segments having a first average cross-sectional filament area and at least a second group of yarn segments having a second average cross-sectional filament area which is at least 1.56 times the first average cross-sectional filament area, and wherein the average level of crystalline orientation of the first group of yarn segments as measured by the Herman Orientation Function is at least 10% greater than the average level of crystalline orientation the second group of yarn segments.

13. The invention as recited in claim 12, wherein the fabric is a Tricot knit fabric.

14. The invention as recited in claim 12, wherein the fabric is a Raschel knit fabric.

15. The invention as recited in claim 12, wherein the common yarn is a multi-filament PET polyester yarn.

16. The invention as recited in claim 12, wherein in the fabric the first group of yarn segments of the common yarn comprises a plurality of substantially smooth parallel yarn filaments and the second group of yarn segments of the common yarn is characterized by a substantially non-parallel arrangement of crimped yarn filaments.

17. The invention as recited in claim 12, wherein in the fabric at least a portion of the yarn filaments in the second group of yarn segments are characterized by a cross sectional area which is at least four times the cross sectional area of one or more yarn filaments in the first group of yarn segments.

18. A method of forming a knit fabric comprising a face portion including a plurality of interconnected yarn loops, wherein at least a portion of the interconnected yarn loops are formed from segments of a common yarn of multi-filament construction and wherein in the fabric the common yarn comprises a first group of yarn segments having a first average cross-sectional filament area and at least a second group of yarn segments having a second average cross-sectional filament area which is greater than the first average cross-sectional filament area, the method comprising the steps of:

underdrawing a partially oriented multi-filament yarn across a heat source at a rate such that portions of the yarn undergo substantially complete heat treatment and other portions do not undergo substantially complete heat treatment;

forming the underdrawn yarn into the knit fabric such that portions of the underdrawn yarn are disposed across the face portion of the fabric; and heating the knit fabric such that portions of the yarn which did not undergo substantially complete heat treatment during the underdrawing undergo selective shrinkage and self texturing.

19. The invention as recited in claim 18, wherein the fabric is a Tricot knit fabric.

20. The invention as recited in claim 18, wherein the fabric is a Raschel knit fabric.

21. The invention as recited in claim 18, wherein the common yarn is a multi-filament PET polyester yarn.

22. The invention as recited in claim 18, wherein in the fabric the first group of yarn segments of the common yarn comprises a plurality of substantially smooth yarn filaments and the second group of yarn segments of the common yarn is characterized by a substantially non-parallel arrangement of crimped yarn filaments.

23. The invention as recited in claim 18, wherein in the fabric the second average cross-sectional filament area is at least 1.56 times the first average cross-sectional filament area.

24. The invention as recited in claim 23, wherein in the fabric at least a portion of the yarn filaments in the second group of yarn segments are characterized by a cross sectional area which is at least four times the cross sectional area of one or more yarn filaments in the first group of yarn segments.

* * * * *